US011758315B2

(12) United States Patent
Sun

(10) Patent No.: US 11,758,315 B2
(45) Date of Patent: Sep. 12, 2023

(54) EARPHONE CASE AND WIRELESS EARPHONE

(71) Applicant: BEIJING XIAOMI MOBILE SOFTWARE CO., LTD., Beijing (CN)

(72) Inventor: Fei Sun, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 17/586,633

(22) Filed: Jan. 27, 2022

(65) Prior Publication Data

US 2023/0061521 A1 Mar. 2, 2023

(30) Foreign Application Priority Data

Aug. 26, 2021 (CN) ..... 202110988010.0

(51) Int. Cl.
*H04R 1/10* (2006.01)
*H04R 1/02* (2006.01)

(52) U.S. Cl.
CPC ..... *H04R 1/1016* (2013.01); *H04R 2420/07* (2013.01); *H04R 2460/17* (2013.01)

(58) Field of Classification Search
CPC ..... H04R 1/1016; H04R 2420/07; H04R 2460/17
USPC ..... 381/74, 334
See application file for complete search history.

(56) References Cited

U.S. PATENT DOCUMENTS

2016/0134961 A1* 5/2016 Shaffer ..... H04R 1/105 381/74
2018/0091884 A1* 3/2018 Minoo ..... H02J 7/0042

FOREIGN PATENT DOCUMENTS

CN 112995835 A * 6/2021 ..... H04R 1/1025
CN 112995835 A 6/2021

OTHER PUBLICATIONS

European Patent Application No. 22153990.1, Search and Opinion dated Jul. 20, 2022, 8 pages.

* cited by examiner

*Primary Examiner* — Ammar T Hamid
(74) *Attorney, Agent, or Firm* — COZEN O'CONNOR

(57) ABSTRACT

An earphone case is for storing a wireless earphone body, and includes a case body and a case cover. A top face and a side face of the case body each have an accommodating groove, the accommodating groove in the top face is configured to be fitted with an ear bud of the wireless earphone body, and the accommodating groove in the side face is configured to be fitted with a stem of the wireless earphone body. The case body is provided with a magnetic member for attracting the wireless earphone body.

19 Claims, 4 Drawing Sheets

EARPHONE CASE AND WIRELESS EARPHONE

CROSS-REFERENCE TO RELATED APPLICATION

This application is based on and claims priority to the Chinese Patent Application No. 202110988010.0 filed on Aug. 26, 2021, the entire content of which is incorporated herein by reference.

TECHNICAL FIELD

The present disclosure relates to a field of electronic devices, and more particularly, to an earphone case and a wireless earphone.

BACKGROUND

A wireless earphone (a true wireless stereo earphone, i.e. a TWS earphone) is generally equipped with a charging case for storage and charging due to its compact structure and small size. The charging case in the related art generally has a profiled groove matched in shape with an earphone body of the wireless earphone. The earphone body usually has a geometrically symmetrical shape, and a volume of the earphone body is small. It is difficult to pick up the earphone body from the charging case, thus bringing inconvenience to a user during use.

SUMMARY

An earphone case for storing a wireless earphone body according to embodiments of a first aspect of the present disclosure includes a case body and a case cover. A top face and a side face of the case body each have an accommodating groove, the accommodating groove in the top face is configured to be fitted with an ear bud of the wireless earphone body, and the accommodating groove in the side face is configured to be fitted with a stem of the wireless earphone body. The case body is provided with a magnetic member for attracting the wireless earphone body.

A wireless earphone according to embodiments of a second aspect of the present disclosure includes a wireless earphone body and an earphone case. The earphone case includes a case body and a case cover. A top face and a side face of the case body each have an accommodating groove, the accommodating groove in the top face is configured to be fitted with an ear bud of a wireless earphone body, and the accommodating groove in the side face is configured to be fitted with a stem of the wireless earphone body. The case body is provided with a magnetic member for attracting the wireless earphone body.

DETAILED DESCRIPTION

Embodiments of the present disclosure are described in detail below, and examples of the described embodiments are shown in accompanying drawings. The following embodiments described with reference to the accompanying drawings are exemplary and are intended to explain the present disclosure, rather than limit the present disclosure.

Figure 3:
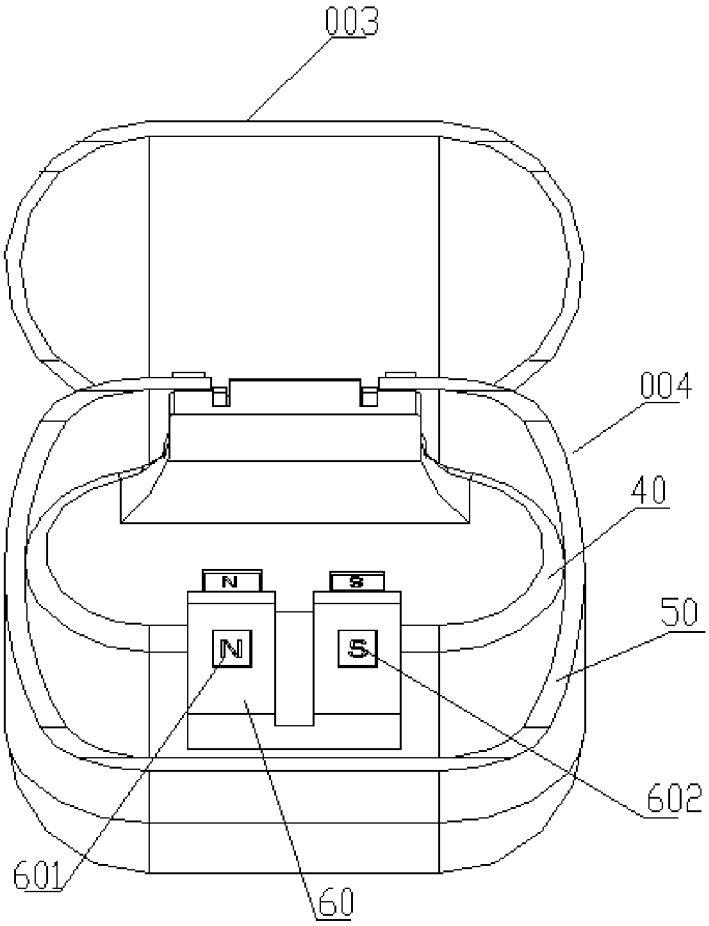
FIG. 3 is a schematic view of an earphone case according to an embodiment of the present disclosure.
Figure 4:
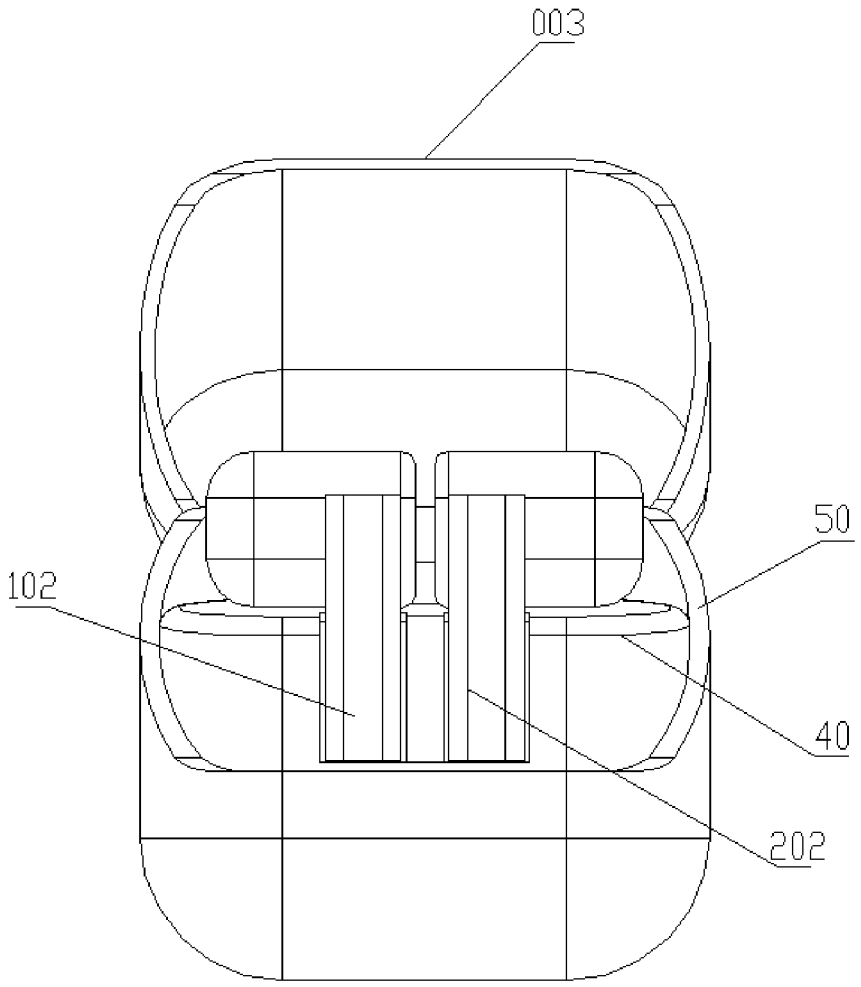
FIG. 4 is a schematic view of a wireless earphone according to an embodiment of the present disclosure.
Figure 5:
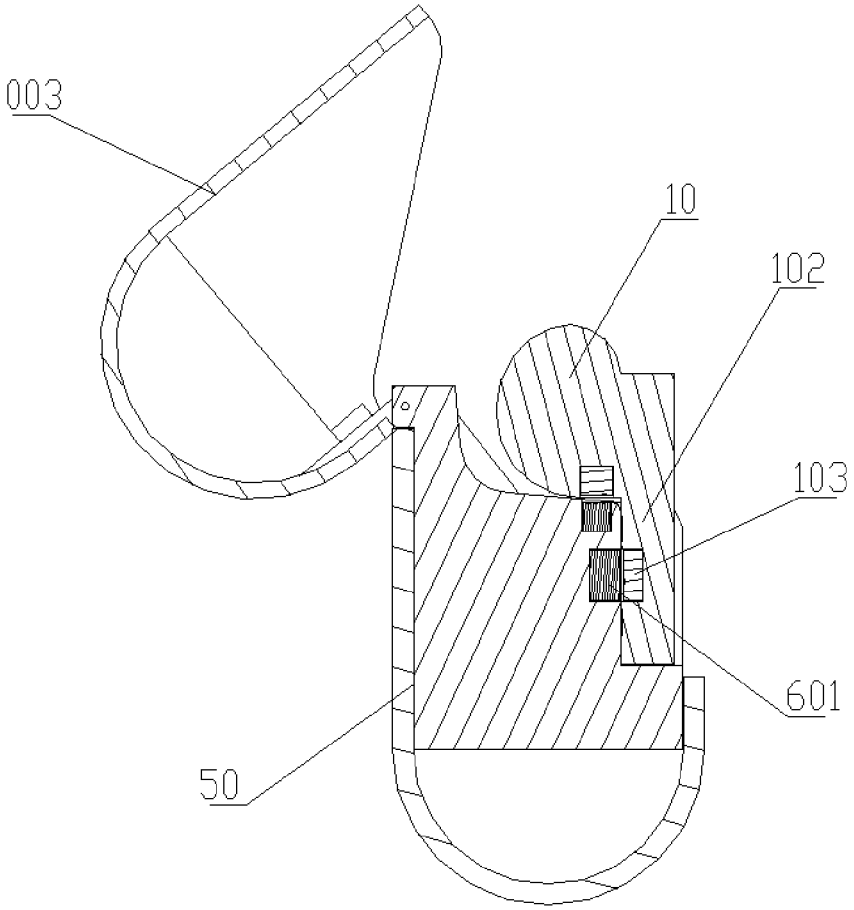
FIG. 5 is a sectional view of the wireless earphone in FIG. 4.

An earphone case according to embodiments of the present disclosure is described below with reference to FIGS. 1-5. Specifically, as shown in FIGS. 3-5, the earphone case includes a case body 004 and a case cover 003, and the case cover 003 is movably connected to a top of the case body 004. A top face and a side face of the case body 004 each have an accommodating groove 60, the accommodating groove 60 in the top face is configured to be fitted with an ear bud of a wireless earphone body, and the accommodating groove 60 in the side face is configured to be fitted with a stem of the wireless earphone body. After the case cover 003 is opened, the wireless earphone body can be completely exposed out of the accommodating grooves. At this time, the wireless earphone body can be taken out in three directions, namely, a vertical direction, an oblique direction and a horizontal direction. The wireless earphone body can be conveniently taken out and placed without being blocked by the case cover. That is, when the earphone case is opened for using, the earphone case is in a semi-open state, so that the wireless earphone body can be taken out conveniently in the vertical direction, the oblique direction and the horizontal direction, that is, the wireless earphone body can be taken out and placed in more diverse manners, which facilitates a user to quickly take out the wireless earphone body. Compared with a technical solution in the related art in which the earphone case adopts a structural form of a profiled groove and the wireless earphone body can only be pulled out vertically upwards, an overall structural design of the earphone case in this embodiment is more concise, the wireless earphone body can be taken out and placed more conveniently, a stroke for taking out and placing in the wireless earphone body is greatly shortened, and the resistance of taking out and placing in the earphone is small. Moreover, when the case cover is opened, more portions of the wireless earphone body are exposed, so that the wireless earphone body can be picked up more conveniently.

It should be noted that a shape of the accommodating groove 60 matches with a shape of the wireless earphone body, so that the accommodating groove is configured to hold the wireless earphone body. That is, the design shape of the accommodating groove can be the same with the shape of the wireless earphone body. When the wireless earphone body is placed, the whole wireless earphone body can be completely put into the accommodating groove, so as to protect the whole wireless earphone body. Therefore, the stability is better, thus preventing an electrical connection between the wireless earphone body and the case body from being broken.

Specifically, the case cover 003 is flippably connected to the case body 004, so that the case cover 003 can be flipped between a closed position and an open position. In the open position, an upper side of the accommodating groove 60 in the top face and a front side of the accommodating groove 60 in the side face are both open, and in the closed position, the case cover 003 covers the upper side of the accommodating groove 60 in the top face and the front side of the accommodating groove in the side face. In other words, the case cover can flip back and forth around a side of the case body which serves as a fulcrum. When the case cover is opened, the accommodating groove in the case body is in an exposed state, and when the case cover is closed, the case cover just completely covers the accommodating groove in the case body.

Specifically, the accommodating groove 60 in the top face matches with the ear bud of the wireless earphone body in shape, and a part of the ear bud of the wireless earphone body can be accommodated in the accommodating groove 60 in the top face. In other words, when the ear bud of the wireless earphone body is placed in the accommodating groove 60 in the top face, a protruding portion of the ear bud facilitates the user to take out and place the wireless earphone body quickly.

Specifically, as shown in FIG. 4, the case body 004 includes a housing 50 and a middle case 40 arranged in the housing 50. The middle case 40 is provided with the accommodating groove 60 configured to accommodate at least the stem of the wireless earphone body. In the open position, that is, when the case cover 003 is opened, the middle case 40 in the case body 004 is completely exposed, and the front side and the upper side of the accommodating groove 60 are both open. In the closed position, the case cover 003 is closed with the housing 50, and the case cover 003 covers the front side and the upper side of the accommodating groove 60, that is, when the case cover 003 is closed, it can be in a complete contact with the case body 004, so as to enclose the accommodating groove 60.

Specifically, the accommodating groove 60 in the side face of the case body 004 has a first accommodating portion configured to accommodate a stem of a left earphone body 001 and a second accommodating portion configured to accommodate a stem of a right earphone body 002, respectively. The case body 004 includes a protrusion arranged in the accommodating groove 60 in the side face of the case body 004, and the protrusion is located between the first accommodating portion and the second accommodating portion, so as to separate the first accommodating portion from the second accommodating portion. In other words, when the left earphone body 001 and the right earphone body 002 are placed, the stem of the left earphone body 001 is placed in the corresponding first accommodating portion and the stem of the right earphone body 002 is placed in the corresponding second accommodating portion respectively, so that the left earphone body 001 and the right earphone body 002 can be placed stably, thus avoiding the left earphone body 001 or the right earphone body 002 from falling off and being lost.

It should be noted that the first accommodating portion and the second accommodating portion can also be in communication with each other. In other words, the stem of the left earphone body 001 and the stem of the right earphone body 002 can be placed in an accommodation cavity formed by the communication between the first accommodating portion and the second accommodating portion, so that it is convenient to take out and place the stem of the left earphone body 001 and the stem of the right earphone body 002 as a whole.

Specifically, as shown in FIG. 5, in which the earphone case and the left earphone body 001 are both cut, the accommodating groove 60 is configured to accommodate the stem, and a top of the middle case 40 is configured to support the ear bud of the wireless earphone body. In other words, a groove depth of the accommodating groove is designed so that only the stem is accommodated. Therefore, the earphone bodies can be fixed, as long as a stem of the left earphone body 001 and a stem of the right earphone body 002 are inserted into the accommodating groove.

Another embodiment of the present disclosure discloses a wireless earphone, including a wireless earphone body and an earphone case. The earphone case is configured to store the wireless earphone body, and the earphone case is the earphone case in the above embodiments. The wireless earphone body includes a left earphone body 001 and a right earphone body 002. When the left earphone body 001 and the right earphone body 002 are placed, the stem of the left earphone body 001 is placed in the corresponding first accommodating portion and the stem of the right earphone body 002 is placed in the corresponding second accommodating portion, respectively.

The case body 004 is provided with a magnetic member for attracting the wireless earphone body. When the wireless earphone body is placed in the case body 004, the wireless earphone body can be well limited through the accommodating grooves 60 formed in the top face and the side face of the case body 004. At the same time, the magnetic member attracts the wireless earphone body in a cooperative manner, so that the wireless earphone body is stably placed in the case body 004, thus avoiding the wireless earphone body from being lost.

Specifically, the case body 004 is provided with at least one magnetic member for attracting the ear bud and at least one another magnetic member for attracting the stem, and the wireless earphone body is provided with a plurality of attraction members in one-to-one correspondence to the magnetic members. In other words, the attraction members are arranged on the ear bud and the stem of the wireless earphone body, and the corresponding magnetic members are arranged in the case body 004. When the wireless earphone body is placed in the case body 004, the magnetic members attract the attraction members, so that the ear bud and the stem of the wireless earphone body can be stably placed in the case body 004, thus avoiding the wireless earphone body from falling off.

Specifically, the magnetic member includes a first magnetic member 601 for attracting the left earphone body 001 and a second magnetic member 602 for attracting the right earphone body 002. A magnetic pole, for attracting the left earphone body 001, of the first magnetic member 601 is opposite to a magnetic pole, for attracting the right earphone body 002, of the second magnetic member 602. In other words, the magnetic members with opposite magnetic poles are arranged on the left earphone body 001 and the right earphone body 002, respectively, so as to maintain a stable state between the left earphone body 001 and the right earphone body 002 in the earphone case, thereby greatly improving the stability of the electrical connection when the wireless earphone body is placed in the case body 004.

As shown in FIGS. 2-5, the wireless earphone body can be easily placed as long as the left earphone body 001 and the right earphone body 002 are placed in corresponding positions. When the wireless earphone body is placed by error, for example, when the right earphone body 002 is placed in a placement position of the left earphone body 001, since the outward magnetic pole of the first magnetic member 601 in the placement position of the left earphone body 001 has the same polarity as the magnetic pole of a second attraction member 203 on the right earphone body 002, which is exposed from a front face 201 of a right stem 202 of the right earphone body 002, the first magnetic member 601 will repel the second attraction member 203, so that it is difficult to place the right earphone body 002.

Further, since the first magnetic member 601 that can correspondingly attract a first attraction member 103 (which is arranged in a left stem 102 of the left earphone body 001) and the second magnetic member 602 that can correspondingly attract the second attraction member 203 are arranged in the case body 004, the left earphone body 001 and the right earphone body 002 can be exactly and easily placed into the corresponding positions, so that the left earphone body 001 and the right earphone body 002 can be prevented from being placed in wrong positions.

Specifically, the left earphone body 001 is provided with the first attraction member 103 corresponding to the first magnetic member 601, the right earphone body 002 is provided with the second attraction member 203 corresponding to the second magnetic member 602, the first attraction member 103 is a first magnetic block, the second attraction member 203 is a second magnetic block, and the wireless earphone body is further provided with a Hall effect switch. When the first attraction member 103 and the second attraction member 203 are attached with each other by attraction, the Hall effect switch is triggered, and the wireless earphone body enters a non-use state. In other words, the left earphone body 001 and the right earphone body 002 are provided with the first attraction member 103 and the second attraction member 203 for triggering the Hall effect switch. When the first attraction member 103 and the second attraction member 203 are attached with each other by attraction, the Hall effect switch is triggered, so that the wireless earphone enters a low-power consumption mode, and maintains a standby state, thus reducing the power consumption and improving the endurance time.

Figure 2:
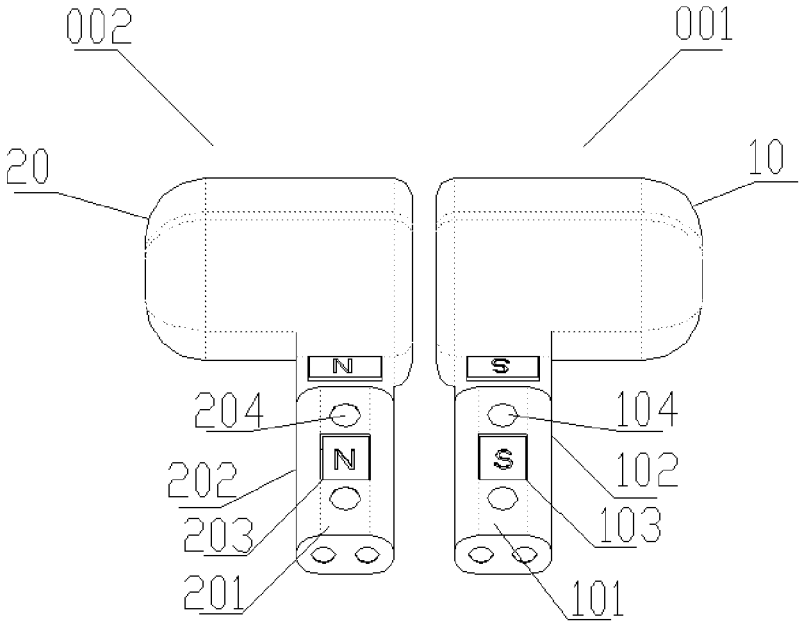
FIG. 2 is a schematic view of left and right earphone bodies attracting each other back-to-back according to an embodiment of the present disclosure.

In some embodiments, as shown in FIG. 2, the left earphone body 001 is provided with a first Hall effect switch 104 arranged on the left stem 102 of the left earphone body 001, and the first Hall effect switch 104 is located above the first attraction member 103; the right earphone body 002 is provided with a second Hall effect switch 204 arranged on the right stem 202 of the right earphone body 002, and the second Hall effect switch 204 is located above the second attraction member 203. When the first attraction member 103 and the second attraction member 203 are magnetically attracted so that the left earphone body 001 and the right earphone body 002 attract each other, the first attraction member 103 can trigger the second Hall effect switch 204 and bring the right earphone body 002 into a low-power consumption state, and the second attraction member 203 can trigger the first Hall effect switch 104 and bring the left earphone body 001 into the low-power consumption state. In other words, when the left earphone body 001 and the right earphone body 002 attract each other back-to-back, a magnetic field generated by the first attraction member 103 can allow the second Hall effect switch 204 to bring the right earphone body 002 into the standby state, i.e., the low-power consumption state, and a magnetic field generated by the second attraction member 203 can allow the first Hall effect switch 104 to bring the left earphone body 001 into the standby state, i.e., the low-power consumption state.

Specifically, when the first attraction member 103 and the first magnetic member 203 attract each other, the first Hall effect switch 104 is triggered, and the left earphone body 001 enters the non-use state; when the second attraction member 203 and the second magnetic member 602 attract each other, the second Hall effect switch 204 is triggered, and the right earphone body 002 enters the non-use state. In other words, when the left earphone body 001 is placed in the first accommodating portion, the first attraction member 103 on the left earphone body 001 and the first magnetic member 601 in the case body 004 attract each other, so as to maintain a stable placement state of the left earphone body 001. At the same time, the left earphone body 001 triggers the first Hall effect switch 104 under an action of magnetic flux of the first attraction member 103 and the first magnetic member 601, so that the left earphone body 001 enters the low-power consumption mode and remains on standby. Similarly, when the right earphone body 002 is placed in the second accommodating portion, it also remains stable and enters the low-power consumption mode.

When the left earphone body 001 and the right earphone body 002 are attached with each other, the Hall effect switch on the corresponding earphone body is triggered through the magnetic block on the different earphone body, so that it is confirmed that the wireless earphone body is in a non-wearing mode, i.e., the user is not using it, and thus the wireless earphone body enters the low-power consumption state, even if other wearing detection functions of the wireless earphone body, such as a capacitive detection unit or a light sensing detection unit, are disturbed. For example, when the wireless earphone body is held by hands or the wireless earphone body is put into a pocket, an ordinary capacitive or light sensing detection will be disturbed, so that the wireless earphone body is misjudged to be in a wearing mode, i.e., a state in which the user uses it, thus resulting in the continuous high-power consumption of the wireless earphone body and wasting the electric energy. Since the left earphone body 001 and the right earphone body 002 are respectively provided with the magnetic blocks having different polarities and the Hall effect switches, the left earphone body 001 and the right earphone body 002 can be stored temporarily in a case that the earphone case is not carried, and also it can be accurately judged that the wireless earphone body is in the non-wearing mode when the left earphone body 001 and the right earphone body 002 attract each other back-to-back, so that the wireless earphone body enters the low-power consumption state, thus reducing the consumption of the power of the wireless earphone body and improving the endurance time of the wireless earphone body.

When the left earphone body 001 and the right earphone body 002 are placed into the earphone case, the first magnetic member 601 and the second magnetic member 602 arranged in the case body 004 can also activate the Hall effect switches on the left earphone body 001 and the right earphone body 002, so as to assist in confirming that the left earphone body 001 and the right earphone body 002 are in the non-wearing state, i.e., the user is not using them, so that the wireless earphone body is kept in the standby state, i.e., in the low-power consumption mode. Even if the electrical connection between the case body 004 and the wireless earphone body is suddenly broken under vibration, since the Hall effect switch on the wireless earphone body is activated by the magnetic block in the case body 004, the wireless earphone body can still maintain the low-power consumption mode, rather than out of the low-power consumption state after being woken up.

In some embodiments, two first magnetic members 601 are provided, the left earphone body 001 is provided with two first attraction members 103 in one-to-one correspondence to the two first magnetic members 601, and the two first attraction members 103 are arranged on the ear bud and the stem of the left earphone body 001 respectively; two second magnetic members 602 are provided, the right earphone body 002 is provided with two second attraction members 203 in one-to-one correspondence to the two second magnetic members 602, and the two second attraction members 203 are arranged on the ear bud and the stem of the right earphone body 002 respectively. In other words, since the case body 004 is provided with two groups of magnetic members attracted with the stem and the ear bud respectively, the corresponding left earphone body 001 and the corresponding right earphone body 002 are attracted by the magnetic members in the case body 004, so that the left earphone body 001 and the right earphone body 002 remain stable in the case body 004 as a whole, thus preventing the wireless earphone body from falling out of the earphone case and being lost.

In some embodiments, as shown in FIG. 2, two first attraction members 103 are provided and arranged on the left stem 102 and a left ear bud 10 respectively, and two second attraction members 203 are provided and arranged on the right stem 202 and a right ear bud 20 respectively. When the number of the first attraction members 103 and the number of the second attraction members 104 are both designed as two, the two first attraction members 103 are arranged on the left stem 102 and a bottom of the left ear bud 10 of the left earphone body 001, respectively. The two first magnetic members 601 on the case body 004 corresponding to the two first attraction members 103 are arranged on the side face and the top face of the case body 004, respectively. The first magnetic member 601 on the side face attracts the first attraction member 103 on the left stem 102, and the first magnetic member 601 on the top face attracts the first attraction member 103 of the bottom of the left ear bud 10. The two second attraction members 203 are arranged on the right stem 202 and a bottom of the right ear bud 20 of the right earphone body 002, respectively. The two second magnetic members 602 on the case body 004 corresponding to the two second attraction members 203 are arranged on the side face and the top face of the case body 004, respectively. The second magnetic member 602 is arranged in parallel with the first magnetic member 601 within the case body 004. The second magnetic member 602 located on the side face of the case body 004 attracts the second attraction member 203 on the right stem 202, and the second magnetic member 602 located on the top face of the case body 004 attracts the second attraction member 203 on the bottom of the right ear bud 20.

It should be noted that the number of the first attraction members 103 and the number of the second attraction members 203 may also be designed as three, four, etc., which can be designed according to actual needs as long as the overall structural strength of the wireless earphone body can be satisfied.

It should be noted that the left earphone body 001 is provided with the first attraction member 103 and the right earphone body 002 is provided with the second attraction member 203, and a magnetization direction of the first attraction member 103 is opposite to a magnetization direction of the second attraction member 203, so that a polarity of the left earphone body 001 and a polarity of the right earphone body 002 are opposite in a corresponding direction. For example, a magnetic pole of the first attraction member 103 exposed from a rear face of the left earphone body 001 is an N pole, and a magnetic pole of the second attraction member 203 exposed from a rear face of the right earphone body 002 is a S pole. According to the theory of opposite magnetic poles attracting each other, the left earphone body 001 and the right earphone body 002 can be attached with each other back-to-back under an action of the first attraction member 103 and the second attraction member 203. Since the left earphone body 001 and the right earphone body 002 are respectively provided with the first attraction member 103 and the second attraction member 203 having opposite polarities in the corresponding direction, the left earphone body 001 and the right earphone body 002 can attract each other in the case that the earphone case is not carried, thus realizing the temporary storage of the wireless earphone body and avoiding losing one earphone body.

In some embodiments, the left earphone body 001 includes the left stem 102 and the left ear bud 10, the left ear bud 10 is connected to a front face 101 of the left stem 102, the left stem 102 is provided with the first attraction member 103, and the first attraction member 103 is embedded in a stem body of the left stem 102 and located below the left ear bud 10. In this embodiment, the first attraction member 103 is arranged in the stem body of the left stem 102 and adjacent to a bottom end of the stem body. It should be noted that the left stem 102 can also be arranged at other positions of the left earphone body 001.

The right earphone body 002 includes the right stem 202 and the right ear bud 20, the right ear bud 20 is connected to the front face 201 of the right stem 202, the right stem 202 is provided with the second attraction member 203, and the second attraction member 203 is embedded in a stem body of the right stem 202 and located below the right ear bud 20.

As shown in FIG. 2, a magnetic pole of the first attraction member 103 exposed from the front face 101 of the left stem is a S pole, so a magnetic pole of the first attraction member 103 exposed from the rear face of the left stem is an N pole; and a magnetic pole of the second attraction member 203 exposed from the front face 201 of the right stem is an N pole, so a magnetic pole of the second attraction member 203 exposed from the rear face of the right stem is a S pole.

Figure 1:
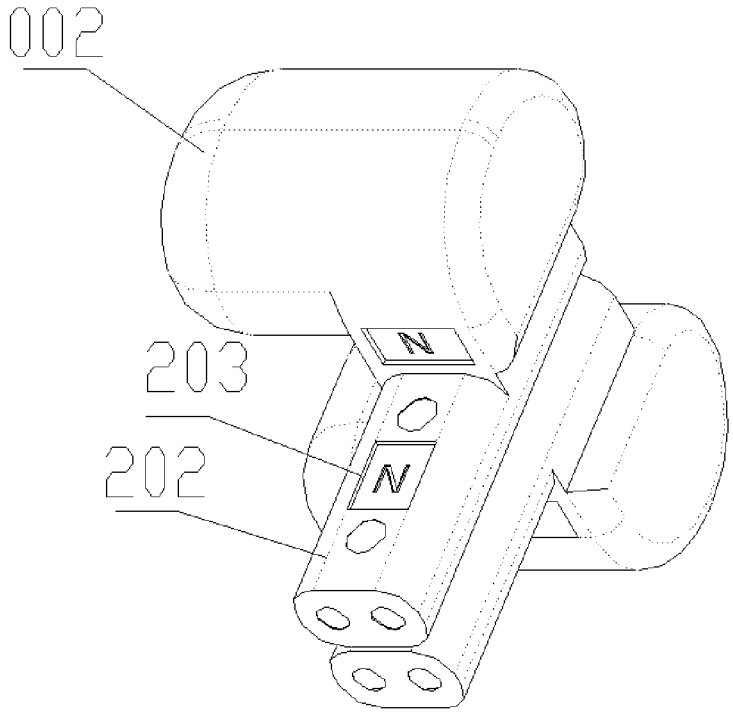
FIG. 1 is a schematic view of a wireless earphone body according to an embodiment of the present disclosure.

As shown in FIG. 1 and FIG. 2, the second attraction member 203 is arranged corresponding to the first attraction member 103, i.e., the second attraction member 203 and the first attraction member 103 are arranged on the right stem 202 and the left stem 102 in a mirrored manner, so that under the attraction between the first attraction member 103 and the second attraction member 203, the rear face of the left stem 102 of the left earphone body 001 and the rear face of the right stem 202 of the right earphone body 002 can be closely attached with each other.

It should be noted that two groups of magnetic blocks with different polarities can further be arranged on a side face of the left ear bud 10 and a face of the right ear bud 20 corresponding to the side face of the left ear bud 10, respectively. The left earphone body 001 and the right earphone body 002 are attached with each other horizontally and closely by means of the two groups of mutually attracted magnetic blocks on the side face of the left ear bud 10 and the side face of the right ear bud 20, so as to realize a function of temporary storage in the case that the earphone case is not carried, thus avoiding losing the wireless earphone body.

It should be noted that two groups of magnetic blocks with different polarities can further be arranged on a side face of the left stem 102 and a face of the right stem 202 corresponding to the side face of the left stem 102, respectively. Since the two groups of magnetic blocks arranged on the side face of the left stem 102 and the side face of the right stem 202 have opposite polarities and attract each other, the left earphone body 001 and the right earphone body 002 can be attached with each other horizontally and closely, so as to realize the function of temporary storage in the case that the earphone case is not carried.

It should be noted that two groups of magnetic blocks with different polarities can further be arranged at a bottom of the left stem 102 and a bottom of the right stem 202, respectively. Since the magnetic blocks at the bottom of the left stem 102 and the bottom of the right stem 202 have opposite polarities and attract each other, the bottom of the left earphone body 001 and the bottom of the right earphone body 002 are attached with each other closely, so as to realize an effect of temporary storage in the case that the earphone case is not carried.

When the left earphone body 001 with the first attraction member 103 and the right earphone body 002 with the second attraction member 203 of the wireless earphone body are placed into the earphone case respectively, the first magnetic member 601 and the second magnetic member 602 in the earphone case attract the first attraction member 103 and the second attraction member 203 respectively, so that the left earphone body 001 and the right earphone body 002 will not be misplaced when placed. Moreover, the left earphone body 001 and the right earphone body 002 can attract each other back-to-back in the case that the earphone case is not carried, so as to realize the effect of temporary storage, thus avoiding losing a single earphone body.

The magnetic field generated by the magnetic block on the corresponding earphone body can trigger the Hall effect switch on the other corresponding earphone body, so that the wireless earphone body enters the non-wearing state, i.e. the low-power consumption state. When the wireless earphone body is placed in the earphone case, the magnetic block in the earphone case generates the magnetic field to trigger the Hall effect switch in the wireless earphone body placed in the corresponding position, and then it is confirmed that the wireless earphone body is in the non-wearing state, i.e., the wireless earphone body is in the standby mode. Moreover, the electrical connection between the earphone case and the wireless earphone body is prevented from being broken suddenly when the earphone case is subject to vibration, and the wireless earphone body can still be in the low-power consumption mode and will not be woken up while the Hall effect switch is triggered.

In the description of the present disclosure, it shall be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience of description and do not indicate or imply that the device or element referred to must have a particular orientation, or be constructed and operated in a particular orientation. Thus, these terms shall not be construed as limitation on the present disclosure.

In addition, terms such as "first" and "second" are merely used for descriptive purposes and cannot be understood as indicating or implying relative importance or the number of technical features indicated. Thus, the features associated with "first" and "second" may explicitly or implicitly include at least one of the features. In the description of the present disclosure, unless otherwise specifically defined, "a plurality of" means at least two, such as two, three, etc.

In the present disclosure, unless otherwise explicitly specified and defined, the terms "mounted," "interconnected," "connected," "fixed" and the like are used broadly, and may be, for example, fixed connections, detachable connections, or integral connections; may also be mechanical or electrical connections or intercommunication; may also be direct connections or indirect connections via intervening structures; may also be inner communications or interactions of two elements, which can be understood by those skilled in the art according to specific situations.

In the present disclosure, unless otherwise explicitly specified and defined, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

In the present disclosure, terms such as "an embodiment," "some embodiments," "an example," "a specific example," or "some examples," means that a particular feature, structure, material, or characteristic described in connection with the embodiment or example is included in at least one embodiment or example of the present disclosure. Thus, the appearances of these terms in various places throughout this specification are not necessarily referring to the same embodiment or example of the present disclosure. Furthermore, the particular features, structures, materials, or characteristics may be combined in any suitable manner in one or more embodiments or examples. In addition, without contradiction, those skilled in the art may combine and unite different embodiments or examples or features of the different embodiments or examples described in this specification.

Although the embodiments of the present disclosure have been shown and described above, it can be understood that the above embodiments are exemplary and shall not be understood as limitation to the present disclosure, and changes, modifications, alternatives and variations can be made in the above embodiments within the scope of the present disclosure.

The invention claimed is:

1. An earphone case for storing a wireless earphone body, comprising:

a case cover; and a case body, a top face and a side face of the case body each having an accommodating groove, the accommodating groove in the top face being configured to be fitted with an ear bud of the wireless earphone body, the accommodating groove in the side face being configured to be fitted with a stem of the wireless earphone body, the case body being provided with a magnetic member for attracting the wireless earphone body, wherein the case cover is flippably connected to the case body, and the case cover is configured to be flipped between a closed position and an open position, in the open position, an upper side of the accommodating groove in the top face and a front side of the accommodating groove in the side face are both open, and in the closed position, the case cover covers the upper side of the accommodating groove in the top face and the front side of the accommodating groove in the side face.

2. The earphone case according to claim 1, wherein the wireless earphone body comprises a left earphone body and a right earphone body, the accommodating groove in the side face has a first accommodating portion and a second accommodating portion, the first accommodating portion is configured to be fitted with a stem of the left earphone body, and the second accommodating portion is configured to be fitted with a stem of the right earphone body.

3. The earphone case according to claim 2, wherein the case body comprises a protrusion arranged in the accommodating groove in the side face, the protrusion is located between the first accommodating portion and the second accommodating portion to separate the first accommodating portion from the second accommodating portion.

4. The earphone case according to claim 2, wherein the first accommodating portion and the second accommodating portion are part of a single accommodating cavity.

5. The earphone case according to claim 1, wherein the accommodating groove in the top face matches in shape with the ear bud of the wireless earphone body, and a part of the ear bud of the wireless earphone body is configured to be accommodated in the accommodating groove in the top face.

6. The earphone case according to claim 1, wherein the case body is provided with at least one magnetic member for attracting the ear bud and at least one another magnetic member for attracting the stem, and the wireless earphone body is provided with a plurality of attraction members in one-to-one correspondence to the magnetic members.

7. The earphone case according to claim 1, wherein the wireless earphone body comprises a left earphone body and a right earphone body, the magnetic member comprises a first magnetic member for attracting the left earphone body and a second magnetic member for attracting the right earphone body, and a magnetic pole, for attracting the left earphone body, of the first magnetic member is opposite to a magnetic pole, for attracting the right earphone body, of the second magnetic member.

8. The earphone case according to claim 7, wherein the left earphone body is provided with a first attraction member corresponding to the first magnetic member, the right earphone body is provided with a second attraction member corresponding to the second magnetic member, the wireless earphone body is further provided with a Hall effect switch, and when the first attraction member and the second attraction member are attached with each other by attraction, the Hall effect switch is triggered, and the wireless earphone body enters a non-use state.

9. The earphone case according to claim 8, wherein when the first attraction member and the first magnetic member attract each other, the Hall effect switch is triggered, and the left earphone body enters the non-use state;

when the second attraction member and the second magnetic member attract each other, the Hall effect switch is triggered, and the right earphone body enters the non-use state.

10. The earphone case according to claim 7, wherein two first magnetic members are provided, the left earphone body is provided with two first attraction members in one-to-one correspondence to the two first magnetic members, and the two first attraction members are arranged on the ear bud and the stem of the left earphone body, respectively;

two second magnetic members are provided, the right earphone body is provided with two second attraction members in one-to-one correspondence to the two second magnetic members, and the two second attraction members are arranged on the ear bud and the stem of the right earphone body, respectively.

11. A wireless earphone, comprising:

a wireless earphone body; and an earphone case configured to store the wireless earphone body, and the earphone case comprising a case body and a case cover, a top face and a side face of the case body each having an accommodating groove, the accommodating groove in the top face being configured to be fitted with an ear bud of the wireless earphone body, the accommodating groove in the side face being configured to be fitted with a stem of the wireless earphone body, the case body being provided with a magnetic member for attracting the wireless earphone body, wherein the wireless earphone body comprises a left earphone body and a right earphone body, the magnetic member comprises a first magnetic member for attracting the left earphone body and a second magnetic member for attracting the right earphone body, and a magnetic pole, for attracting the left earphone body, of the first magnetic member is opposite to a magnetic pole, for attracting the right earphone body, of the second magnetic member.

12. The wireless earphone according to claim 11, wherein the case cover is flippably connected to the case body, and the case cover is configured to be flipped between a closed position and an open position, in the open position, an upper side of the accommodating groove in the top face and a front side of the accommodating groove in the side face are both open, and in the closed position, the case cover covers the upper side of the accommodating groove in the top face and the front side of the accommodating groove in the side face.

13. The wireless earphone according to claim 11, wherein the accommodating groove in the side face has a first accommodating portion and a second accommodating portion, the first accommodating portion is configured to be fitted with a stem of the left earphone body, and the second accommodating portion is configured to be fitted with a stem of the right earphone body.

14. The wireless earphone according to claim 13, wherein the case body comprises a protrusion arranged in the accommodating groove in the side face, the protrusion is located between the first accommodating portion and the second accommodating portion to separate the first accommodating portion from the second accommodating portion.

15. The wireless earphone according to claim 13, wherein the first accommodating portion and the second accommodating portion are part of a single accommodating cavity.

16. The wireless earphone according to claim 11, wherein the left earphone body is provided with a first attraction member corresponding to the first magnetic member, the right earphone body is provided with a second attraction member corresponding to the second magnetic member, the wireless earphone body is further provided with a Hall effect switch, and when the first attraction member and the second attraction member are attached with each other by attraction, the Hall effect switch is triggered, and the wireless earphone body enters a non-use state.

17. The wireless earphone according to claim 16, wherein when the first attraction member and the first magnetic member attract each other, the Hall effect switch is triggered, and the left earphone body enters the non-use state;

when the second attraction member and the second magnetic member attract each other, the Hall effect switch is triggered, and the right earphone body enters the non-use state.

18. The wireless earphone according to claim 11, wherein two first magnetic members are provided, the left earphone body is provided with two first attraction members in one-to-one correspondence to the two first magnetic members, and the two first attraction members are arranged on the ear bud and the stem of the left earphone body, respectively;

two second magnetic members are provided, the right earphone body is provided with two second attraction members in one-to-one correspondence to the two second magnetic members, and the two second attraction members are arranged on the ear bud and the stem of the right earphone body, respectively.

19. An earphone case for storing a wireless earphone body, comprising:

a case cover; and a case body, a top face and a side face of the case body each having an accommodating groove, the accommodating groove in the top face being configured to be fitted with an ear bud of the wireless earphone body, the accommodating groove in the side face being configured to be fitted with a stem of the wireless earphone body, the case body being provided with a magnetic member for attracting the wireless earphone body, wherein the accommodating groove in the top face matches in shape with the ear bud of the wireless earphone body, and a part of the ear bud of the wireless earphone body is configured to be accommodated in the accommodating groove in the top face.

* * * * *